United States Patent [19]

Maloney, II

[11] Patent Number: 4,811,751

[45] Date of Patent: Mar. 14, 1989

[54] COLLAPSIBLE AND EXPANDABLE TENT

[75] Inventor: William J. Maloney, II, East Aurora, N.Y.

[73] Assignee: The Quaker Oats Company, Chicago, Ill.

[21] Appl. No.: 232,522

[22] Filed: Aug. 12, 1988

Related U.S. Application Data

[63] Continuation of Ser. No. 920,697, Oct. 17, 1986, abandoned.

[51] Int. Cl.[4] ..... E04H 15/44; E04H 15/04; E04H 15/02; A63H 3/52

[52] U.S. Cl. ..... 135/106; 135/90; 135/96; 446/476

[58] Field of Search ..... 446/476, 478, 487; 135/106, 90, 96, 100, 101, 102, 103, 104, 105, 107

[56] References Cited

U.S. PATENT DOCUMENTS

| | | | |
|---|---|---|---|
| 459,764 | 9/1891 | Orr | 135/90 X |
| 1,599,213 | 9/1926 | Coupal | 135/100 |
| 1,702,946 | 2/1929 | Powers et al. | 24/230.5 TP |
| 2,159,273 | 5/1939 | Killinger | 135/104 X |
| 2,302,650 | 11/1942 | Anderson et al. | 135/100 X |
| 2,601,374 | 6/1952 | Ditzler et al. | 446/487 X |
| 2,698,178 | 12/1954 | Williams | 135/106 X |
| 2,754,550 | 7/1956 | Johnson et al. | 135/100 X |
| 2,796,877 | 6/1957 | Berseth | 135/100 |
| 2,865,385 | 12/1958 | Crafts | 135/90 X |
| 2,956,108 | 10/1960 | Brenner | 403/391 X |
| 3,037,517 | 6/1962 | Zent | 135/104 X |
| 3,156,497 | 11/1964 | Lessard | 135/90 X |
| 3,525,290 | 8/1970 | Pelsue | 135/104 |
| 3,550,601 | 12/1970 | Peters | 135/102 X |
| 4,067,137 | 1/1978 | Korthase | 446/478 |
| 4,085,762 | 4/1978 | O'Brian et al. | 446/478 X |
| 4,192,333 | 3/1980 | Sato | 135/102 |
| 4,224,721 | 9/1980 | Ohlson | 24/230.5 AD |
| 4,236,543 | 12/1980 | Moss | 135/105 X |
| 4,352,362 | 10/1982 | Nichols | 135/98 |
| 4,520,835 | 6/1985 | Moeller | 135/102 |

FOREIGN PATENT DOCUMENTS

| | | | |
|---|---|---|---|
| 2319796 | 10/1974 | Fed. Rep. of Germany | 135/104 |
| 30131178 | 11/1981 | Fed. Rep. of Germany | 135/104 |
| 2373312 | 8/1976 | France | 446/478 |
| 7708497 | 2/1978 | Netherlands | 135/102 |
| 116175 | 4/1946 | Sweden | 135/102 |
| 9235 | 5/1899 | United Kingdom | 135/102 |

*Primary Examiner*—Robert A. Hafer
*Assistant Examiner*—D. Neal Muir
*Attorney, Agent, or Firm*—Cumpston & Shaw

[57] ABSTRACT

A tent is disclosed that is readily collapsible into a unitary flat package which can be readily stored on a hanger in a closet. When it is desired to "set up" the tent, a pair of latches are released and the tent automatically assumes or expands into a fully "set up" or erect condition. The tent comprises a fabric or canvas body mounted on corner posts secured to the ends of a pair of flexible bent rods arranged in criss-crossed relation. The inherent tension in the bent rod automatically expands the tent body into its fully erect position. The tent can be readily collapsed into a flat package by manually moving the front and back corner posts and rods together so that they lie in intersecting planes that define a small acute angle therebetween. Latches are provided on the rods for latching the two rods and tent in its collapsed condition.

12 Claims, 1 Drawing Sheet

COLLAPSIBLE AND EXPANDABLE TENT

This is a continuation of co-pending application Ser. No. 920,697 filed on Oct. 17, 1986 now abandoned.

BACKGROUND OF THE INVENTION

1. Field of the Invention

This invention relates generally to tents, and more particularly to a readily collapsible and expandable tent.

2. Description of the prior art

One of the most enjoyable and relatively inexpensive recreational pursuits indulged in by families is camping. In addition to family camping, children generally love to indulge in organizational camp outings arranged, for example, by scout groups. When not indulging in the real thing, children love to act out camping in the home. One problem is that to date no tents are known that can be automatically "set up" in seconds to enable the children to enter and leave the tent with ease, and when they are through camping for real, or playing, to collapse and store the tent quickly without the loss of any parts.

SUMMARY OF THE INVENTION

An object of the present invention is to provide a readily collapsible and expandable tent comprising:

a tent body of fabric or canvas having four corners;

a first flexible bent rod having one end portion secured to a first corner and its opposite end portion secured to a second corner diagonally across from the first corner;

a second flexible bent rod having one end portion secured to a third corner and its opposite end portion secured to a fourth corner diagonally across from the third corner with the mid-portions of the first and second rods arranged in criss-crossed relation; and latch means coupling mid-portions of the first and second rods for releasably holding the tent body in a collapsed condition and the first and second rods in a maximum tensioned condition, the first and second rods automatically moving to a less tensioned condition and thereby automatically fully expanding the tent body when the latch means is released.

In a more specific object of the invention, each corner of the tent body has a pocket or sleeve for receiving the free end of one of the bent rods. The latch means that couples the mid-portions of the rods comprises a hook member having one end secured to one of the rods, and a hook at its opposite end for engaging the other rod.

The problem of the unavailability of tents that may be erected quickly and automatically, merely by releasing a couple of latches, for both real or imaginary camping, is solved by this invention. When real or play camping is concluded, the tent can be quickly collapsed and latched into a substantially flat package and can be readily stored in a closet or the like.

The invention and its advantages will become more apparent from the detailed description of the invention presented below.

BRIEF DESCRIPTION OF THE DRAWINGS

In the detailed description of the invention presented below, reference is made to the accompanying drawings, in which.

DETAILED DESCRIPTION OF THE INVENTION

Figure 1:
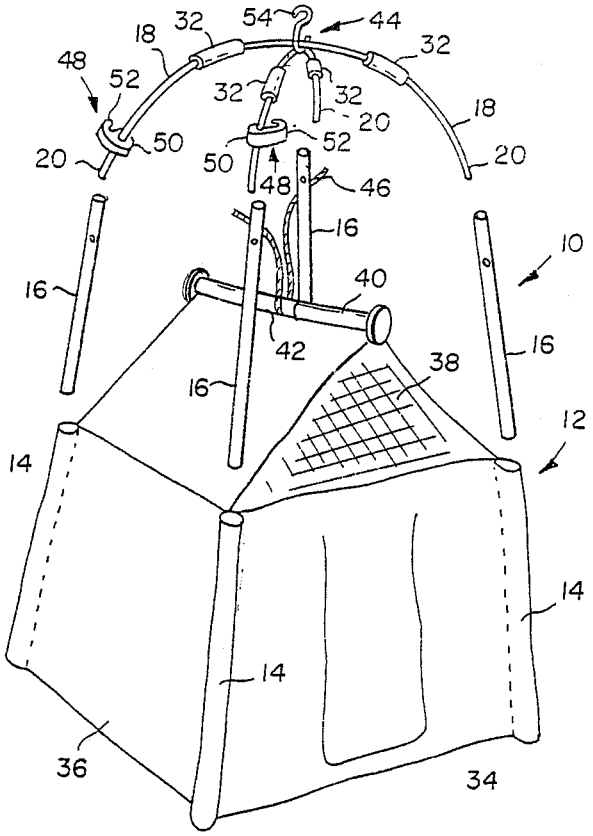
FIG. 1 is an exploded perspective view of a preferred embodiment of the collapsible and expandable tent of this invention.
Figure 2:
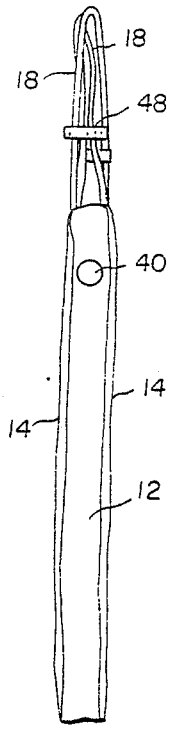
FIG. 2 is a side elevation view of the toy tent in its collapsed condition.
Figure 4:
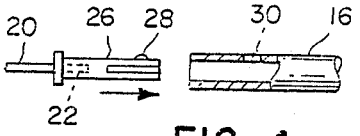
FIG. 4 is a segmented exploded view showing one way of connecting the end of a rod to the end of a corner tube.

With reference to FIG. 1, a preferred embodiment of the collapsible and expandable tent 10 of this invention is disclosed in exploded form. The tent 10 comprises a tent body 12 formed from any suitable fabric material, canvas, or the like. The tent body has pockets or sleeves 14 along each corner thereof for receiving rigid corner posts or tubes 16 of aluminum or plastic. Flexible fiberglass rods 18 that are normally straight have one end of one rod inserted into one of the corner tubes 14 and the opposite end thereof inserted into a corner tube diagonally across from the other tube. Each free end 20 of the rods is inserted into and secured to a blind bore 22 in a coupling 24. The coupling has a pair of longitudinally extending fingers 26 spaced apart with at least one of the fingers being flexible and being provided with a laterally extending lug 28. The complementary end of the tube 16 has a radially extending opening 30 for receiving lug 28 when coupling 24 at the end of the rod is inserted into the open end of the tube. The lug 28 and opening 30 form a detent means for releasably securing each end of rod 20 to the complementary end of corner tube 16. Each rod 20 may be formed of a plurality of small rods, having aligned opposite ends secured together by any suitable connectors 32. The tension of the flexed or bent rods 20 when the couplings at the ends thereof are inserted into corner tube 16 forces sleeves 14 of tent body 12 outwardly expanding the tent into its erect position.

The tent body further has a front end 34, a rear end, two sides 36 and a gabled roof 38 provided with a sleeve 40 along the ridge for receiving a ridge pole 42. The ridge pole is secured to the criss-crossed portion 44 of the rods by a tie lace 46 passing underneath ridge pole 42 and tied above the rods after the tie lace is pulled fairly snug.

Figure 3:
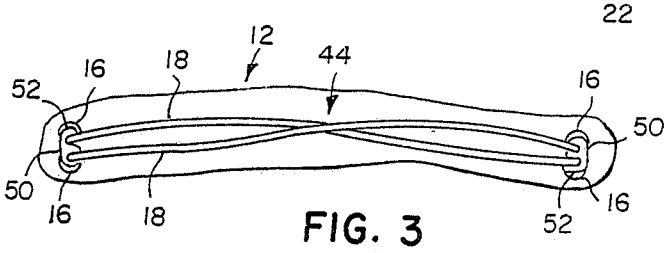
FIG. 3 is a top plan view of the collapsed tent of FIG. 2.

The tent 10 is provided with latch means for coupling mid-portions of rod 18 for releasably holding tent body 12 in a collapsed condition against the natural tendency of the rods to straighten out. The latch means comprise a pair of hook members 48, each having an opening at one end 50, through which one end of each of the rods 18 extends. The hook members 48 are slidably mounted on the rod ends that are on the same side of the tent to facilitate releasing both hooks from that side. To collapse the tent, the corners of the tent at one of the front or rear ends are pulled together and the hook end 52 of hook member 48 adjacent that end is placed over the other rod 18. The corners of the tent at the other of the front and rear ends are then pulled together while stuffing the excess fabric towards the opposite end of the tent. The hook end 52 of hook member 48 is placed over the adjacent complementary rod 18 for holding the tent in its collapsed condition for storage or transporting. In this collapsed condition, the rods 18 lie in interesting plans that define a small acute angle therebetween, as best seen in FIG. 3. Any suitable hanger 54 can be connected to the criss-crossed portion 44 of rods 18 for hanging the collapsed tent 10 in any suitable storage area, such as a closet. When it is desired to set up the tent, the collapsed tent is transported to the area where it is to be erected and the hooks 52 of hook members 48 are unsnapped, preferably from one side of the tent, whereupon the tensioned rods 18 automatically pop the tent into its erected or expanded position.

While a preferred embodiment of the invention has been shown and described with particularity, it will be appreciated that various changes and modifications may suggest themselves to one having ordinary skill in the art upon being apprised of the present invention. It is intended to encompass all such changes and modifications as fall within the scope and spirit of the appended claims.

What is claimed is:

1. A collapsible and expandable tent for children comprising:

a tent body of fabric or canvas having four corners;

a flexible bent rod having one end portion secured to a first corner of the tent body and its opposite end portion secured to a second corner of the tent body diagonally across from the first corner;

a second flexible bent rod having one end portion secured to a third corner of the tent body, and its opposite end portion secured to a fourth corner of the tent body diagonally across from the third corner whereby the first and second rods are arranged in criss-crossed relation; and releasable latch means on said rods, each means engageable with the other rod for releasably holding the first and second rods closely adjacent to each other along their length with two sides of the tent body collapsed when the tent body is in a collapsed condition and with the first and second rods in a more tensioned condition, the first and second rods automatically moving to a less tensioned condition and thereby automatically fully expanding the tent body when the latch means is released.

2. A collapsible and expandable tent according to claim 1 wherein each corner of said tent body has a pocket for receiving a free end of one of the first and second rods.

3. A collapsible and expandable tent according to claim 2 wherein the tent body has a ridge pole, and a flexible lace secures the ridge pole to the criss-crossed first and second rods.

4. A collapsible and expandable tent according to claim 1 wherein the latch means comprises a hook member having one end secured to one of the first and second rods and a hook at its opposite end for engaging the other of the first and second rods.

5. A collapsible and expandable tent according to claim 4 wherein a pair of hook members are provided, one hook member on each of the first and second rods.

6. A collapsible and expandable tent according to claim 5 wherein the one end of each hook member is slidably mounted on one of the first and second rods.

7. A collapsible and expandable tent according to claim 6 wherein each of the first and second rods is of one diameter, and has a cylindrical portion at each end thereof of a greater diameter than the one diameter.

8. A collapsible and expandable tent according to claim 7 wherein the cylindrical portion comprises a tubular member, and further comprising means for coupling each end of the first and second rods to an end of a complementary tubular member.

9. A collapsible and expandable tent according to claim 7 comprising a coupling member having a flexible finger attached at each end of the first and second rods said finger having a laterally extending lug, and a radially extending opening at an end of each tubular member for receiving the lug.

10. A collapsible and expandable tent according to claim 7 and further comprising hang means connected to the first and second rods for hanging the collapsed tent on a hook.

11. A method for collapsing and expanding a tent for children having a tent body made of fabric or canvas having four corners, first and second flexible bent rods, each rod having its end portion secured to diagonally opposed corners of the tent body, comprising:

moving said rods to a position adjacent to each other with the ends of each rod positioned more closely to each other than when the tent is expanded, and the rods are in an increased tensioned condition two sides of the tent are collapsed and the tent is reduced to a substantially flat state;

latching said rods in said increased tensioned position; and expanding said tent to an erected condition by releasing said rods so that said rods are moved to a less tensioned condition in which the ends of each rod are at a greater distance from each other and the rods assume a non-adjacent criss-crossed configuration whereby the tent is expanded to a useable position.

12. The method of claim 12 further comprising supporting an upper portion of said tent body from an intermediate portion of said bent rods when said tent is in said expanded position.

* * * * *